US005509875A

United States Patent [19]

Moretti

[11] Patent Number: 5,509,875

[45] Date of Patent: Apr. 23, 1996

[54] EXERCISE APPARATUS

[76] Inventor: Massimo Moretti, Via Eynard, 37, 48024 Massalombarda (Ravenna), Italy

[21] Appl. No.: 291,662

[22] Filed: Aug. 17, 1994

[51] Int. Cl.[6] ..... A63B 69/34

[52] U.S. Cl. ..... 482/90; 482/83; 482/86; 482/4

[58] Field of Search ..... 273/55 A, 55 R; 482/83–90, 901, 1–8

[56] References Cited

U.S. PATENT DOCUMENTS 4,401,303 8/1983 Anderson et al. ..... 482/83

5,314,391 5/1994 Potash et al. ..... 482/901

*Primary Examiner*—Jerome Donnelly

*Attorney, Agent, or Firm*—Fay, Sharpe, Beall, Fagan, Minnich & McKee

[57] ABSTRACT

An exercise apparatus designed in particular for martial arts training has a moving target mounted to the top end of a supporting arm which is set in motion by a drive system activated through the agency of an electronic processor, piloted either by a written program or by a random sequence, when the proximity or the movement of the athlete is picked up by a sensor.

3 Claims, 1 Drawing Sheet

R
2
21
22
31
3
1
39
32
4
40
5
6
41
7

36
33
34
36
41

33
49
49
36
36
38
37
48
38
42
48
36
39
49
41
49

52
51
53
40
55
6
54

EXERCISE APPARATUS

BACKGROUND OF THE INVENTION

The present invention relates to the art field of gymnasium equipment, and in particular to a piece of exercise apparatus for use as a training aid in sports such as martial arts.

In training sessions for combat sports generally, it is the practice to utilize targets consisting in an element designed to receive blows struck by the athlete with the upper limbs, and on occasion with the lower limbs also.

One such apparatus employed for this purpose is the classic punching ball, that is, a ball of leather or rubber suspended between two vertically disposed elastic ropes, or hung from an overhead support by means of an articulated fitting. In certain cases, the punching ball is fitted to a support consisting in a substantially rigid rod secured to the floor, anchored at the bottom end with a flexible coupling and maintained thus in a vertical at-rest position.

The target is not capable of spontaneous movement in any of the arrangements mentioned thus far its displacement resulting in practice exclusively from the elastic reaction of the supporting components to the blows delivered by the athlete.

This dictates a certain predictability in the way that the target responds, with the result that the exercise regime tends to become repetitive, and the athlete tends to find him/herself interacting with an apparatus liable to counter in the same manner every time, without guaranteeing that variety of situations which rather will occur in competition, and must therefore be necessary to a comprehensive training program.

The object of the present invention is to provide an exercise apparatus comprising a target capable of spontaneous and substantially unpredictable movement in response to any given movement of the user.

SUMMARY OF THE INVENTION

The stated object is duly realized in an apparatus according to the present invention, which comprises a moving target mounted to a supporting arm and set in motion through the agency of drive means piloted by electronic processing means on the basis of a written program or a random sequence, in response either to the presence or to the movements of an athlete as detected by suitable sensing means.

Advantageously, when the user approaches to within a given distance of the apparatus, the drive means will be activated and the target consequently set in motion, describing trajectories characterized by direction and/or velocity that cannot be predicted by the user.

BRIEF DESCRIPTION OF THE DRAWINGS

A preferred embodiment of the present invention will now be described in detail, by way of example, with the aid of the accompanying sheet of drawings, in which.

DESCRIPTION OF THE PREFERRED EMBODIMENTS

Referring to the accompanying drawings, an exercise apparatus 1 according to the invention comprises at least one element 2 which is designed to receive blows, and in effect provides the target to be hit by the athlete using the apparatus.

Figure 1:
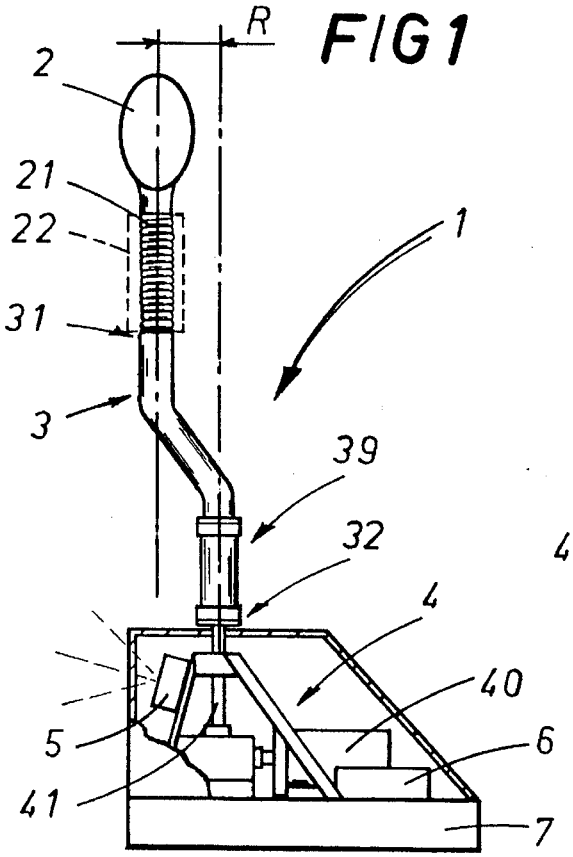
FIG. 1 shows the apparatus disclosed in a side elevation, with certain parts omitted better to reveal others.

The hitting element or target 2 is connected at the bottom, as shown in FIG. 1, to a supporting arm 3 set in motion by the output shaft 41 of a motor 40 that forms a part of drive means denoted 4 in their entirety.

The supporting arm 3 is fashioned in such a manner that a first end 31, connected to the target 2, is offset from a second end 32 connected to the drive shaft 41. This allows the target 2 to describe a circular trajectory of radius denoted R (equivalent to the offset between the two ends 31 and 32), when the drive shaft 41 is set in rotation.

In practice, the supporting arm 3 comprises a rigid structure, or core element 33, exhibiting at least one angled or curvilinear section and ensheathed preferably by a tubular cladding element 34 which is fashioned from shockproof material.

The core element 33 is joined at the second end 32 to the drive shaft 41 by way of a clutch-coupling device 39 such as will release the supporting arm 3 from the shaft 41 in the angular direction in the event of the target 2 being subjected to a stress of value greater than a predetermined limit. The clutch-coupling device can be embodied in a variety of ways.

Figure 3:
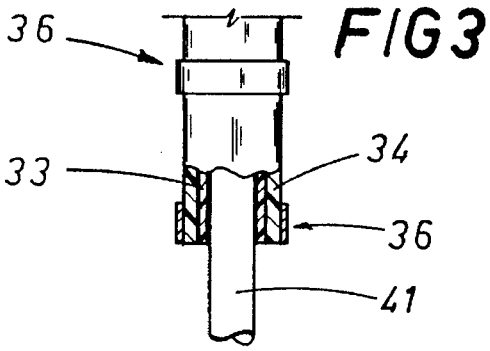
FIG. 2 and FIG. 3 are two side elevations showing a detail of the apparatus of FIG. 1, enlarged and with certain parts omitted, respectively indicating two possible alternative arrangements of the connection between the target supporting arm and the drive system.

One example of embodiment is illustrated in FIG. 3, where the core element 33 affords a socket 37 such as will accept a cylindrical end portion 42 of the drive shaft 41, thereby allowing the shaft 41 to rotate freely in relation to the supporting arm 3 and at the same time ensuring that the position of alignment between the arm 3 and the shaft 41 is correctly maintained; in short, the end portion 42 will penetrate the socket 37 sufficiently to ensure the arm 3 is stably supported.

The tubular cladding element 34, which might be fashioned in rubber, is extended to the point of covering a portion of the shaft 41 in addition to the end portion 42 and secured both to the arm 3 and to the shaft 41 by means of clips 36 able to exert a variable clamping action, thereby allowing the shaft 41 and the arm 3 to decouple if subjected to excessive stresses.

Figure 2:
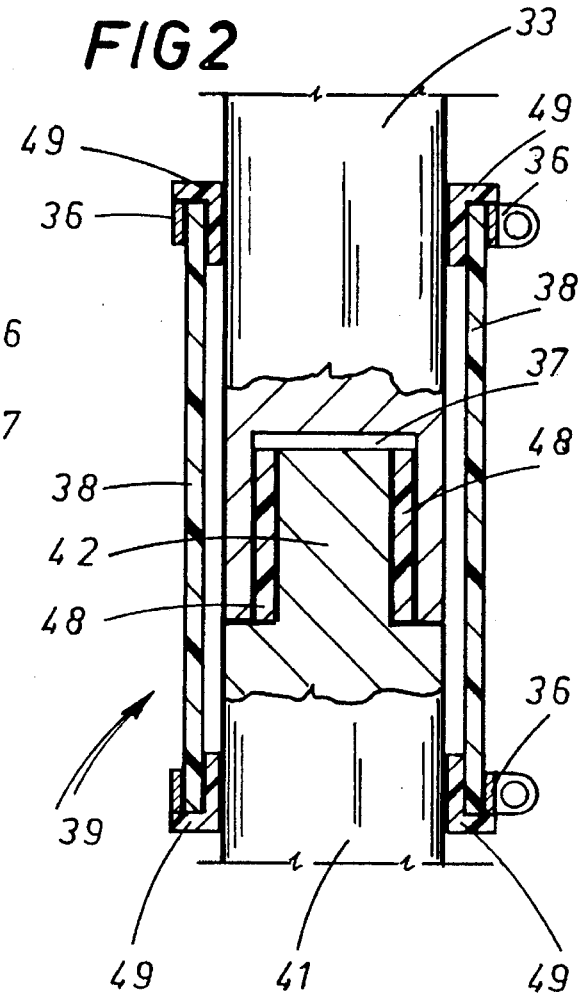

In another possible embodiment, shown in FIG. 2, the connection between the supporting arm 3 and drive shaft 41 is ensheathed by a sleeve 38 of flexible and resilient material (for example, a portion of suitably thick rubber tube).

The sleeve 38 is secured by clamping means 36 able to exert a variable gripping action (consisting, for example, in clips identical to those of the first embodiment described), thereby functioning both as a clutch-coupling device 39 in the manner already intimated, and as a flexible coupling for the drive shaft 41.

Both the shaft 41 and the arm 3 can be fashioned in metal, whilst the connection between the arm 3 and the sleeve 38, and likewise between the shaft 41 and the sleeve 38, might be made by way of plastic bushes 49 (preferably of split design) in such a way as to minimize friction between the associated parts.

Similarly, the socket 37 afforded by the supporting arm 3 might be lined with one or more bushes to optimize the interaction with the end portion 42. By varying the strength of the clamping action, it becomes possible to raise or lower the threshold at which the clutch coupling releases, resulting in a system that is particularly simple and economic, and easy both to maintain and to transport.

The target 2 is mounted to the first end 31 of the supporting arm 3 by way of a flexible connecting element 21 (typically a metal spring, which might be covered by a protective boot 22) such as will provide a permanent anchorage capable of reacting elastically to the force of the blows delivered by the user, without the rigidity of the supporting arm 3 being in any way diminished.

By this expedient, the target 2 remains permanently attached to the arm 3 while retaining the requisite flexibility, unlike floor-mounted punching balls of traditional embodiment which are associated rigidly with a rod anchored by a spring at the base.

The drive shaft 41 might extend directly from the motor 40 or alternatively, shaft and motor could be connected by a coupling shaft or a speed reducer, as indicated schematically in FIG. 1.

Also forming a part of the apparatus are proximity sensing means 5 designed to detect the presence or movement of the athlete or user, and electronic processing means 6 interposed between the sensing means 5 and the drive means 4, by which the drive means are activated on receipt of a control signal from the sensing means 5 and on the basis either of a set program or of a random sequence: in this way, the target 2 can be made to describe trajectories which are variable at least directionally.

To ensure a suitably sharp movement of the target, the specifications of the motor 40 will need to include superior mechanical strength and starting speed.

A preferred embodiment of the apparatus would be one using an electric motor operated at low voltage (around 20 volts, for example), so as to avoid the high starting currents typical of motors operating at higher voltages such as 220 V. Adopting a low voltage d.c. motor, furthermore, the direction of rotation can be reversed simply by inverting the polarity of the supply voltage.

The sensing means 5 might be embodied in a variety of ways: for example a device designed to transduce a movement of the athlete, picked up by means of electromagnetic waves (e.g. radar) or ultrasounds, into an electrical signal capable of activating the drive means 4.

Figure 4:
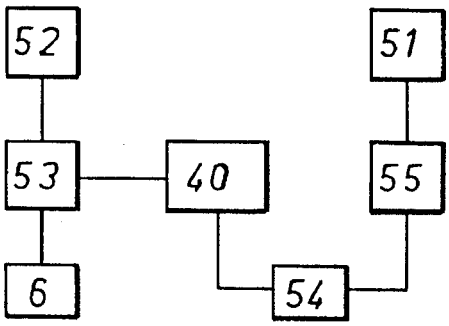
FIG. 4 is a block diagram illustrating one possible configuration of the apparatus disclosed.

The electronic processing means might comprise at least one electronic controller 6 as indicated in FIG. 4, including an EPROM which will determine the movement of the target 2, for example on the basis of a notably long memorized sequence, independently of the activation of the motor 40, in such a manner that it will be substantially impossible to predict the trajectory.

The interaction between the apparatus 1 and the user could occur, as already intimated, by way of a radar type detection device 51; in this instance, a return wave would provide the medium whereby each movement of the athlete triggers a corresponding movement of the target, and in addition, a variable control function applied to the average speed of rotation of the drive shaft could be used to select the difficulty factor desired in training.

Referring to the diagram of FIG. 4, the detection device 51 is one by which any given movement of the athlete can be picked up (with microwave radar, for example) and converted into an electrical signal; the signal is used to enable a power controller 55 capable of delivering current to a power supply circuit 54, which in turn will feed current to the rotor of the motor 40.

The field winding of the motor 40 will be excited separately from the rotor, such that the direction of the d.c. input will determine the direction of rotation.

The field excitation can be controlled by two power transistors 53, which determine the direction of the current flowing through the relative winding, the transistors 53 being driven by a relative dual excitation circuit 52 and piloted by the electronic controller 6 incorporating the EPROM.

The entire assembly of electrical, mechanical and electronic components will be housed internally of a container or base 7, to which the sensing means 5 are also mounted.

What is claimed:

1. A martial arts training device comprising:

a target means configured to receive blows from an athlete, a vertically oriented rigid support arm having an upper most first end connected to the target element and a second lower end, the support arm having at least two vertically oriented sections being offset from each other by an intermediate arm section, thereby positioning the vertically oriented sections and each respective end of said support arm in distinct vertical planes of alignment, a clutch coupling device, a drive means, said drive means comprising a motor and drive shaft, the shaft being connected to said second lower end of the support arm by the clutch coupling device, the drive means being capable of imparting a clockwise counter clockwise rotational motion to the support arm and the clutch coupling device being configured to rotatably release the supporting arm from the shaft, in the event of the target element being subjected to stresses of any value greater than a predetermined limit, sensing means capable of detecting the movement of an athlete, and;

electronic processing means linking the sensing to the drive means, wherein the drive means is activated in response to the detection of movement of an athlete and wherein the drive means is activated in response to a selected program or random sequence generated by said processing means.

2. A martial arts training device as claimed in claim 1 wherein the drive shaft includes a cylindrical end portion which is inserted into and freely rotatable in a mating socket positioned in the second end of the supporting arm, the resulting connection is ensheathed by a sleeve secured respectively to the support arm and to the drive shaft by clamping means which are adjustable in clamping force, thereby allowing said sleeve to function both as a clutch coupling device and as a flexible coupling for said drive shaft.

3. A martial arts training device comprising:

a target means configured to receive blows from an athlete, a flexible connecting element having a first and a second end, a vertically oriented rigid support arm having an upper most first end and a second lower end, said upper most first end connected to said second end of said flexible connecting element, the support arm having at least two vertically oriented sections being offset from each other by an intermediate arm section, thereby positioning the vertically oriented sections and each respective end of said support arm in distinct vertical planes of alignment, said first end of said flexible connecting element being attached to said target means, a drive means, said drive means including a motor and drive shaft, the shaft being connected to said second lower end of said support arm, said drive means being capable of imparting a clockwise and counter clockwise motion to said support arm, sensing means capable of detecting the movement of an athlete, and;

electronic processing means linking the sensing means to the drive means, wherein the drive means is activated in response to the detection of movement of an athlete and wherein the drive means is activated in response to a selected program or random sequence generated by said processing means.

* * * * *